United States Patent [19]

Upchurch

[11] Patent Number: 4,474,242

[45] Date of Patent: Oct. 2, 1984

[54] ANNULUS PRESSURE CONTROLLED REVERSING VALVE

[75] Inventor: James M. Upchurch, Stafford, Tex.

[73] Assignee: Schlumberger Technology Corporation, New York, N.Y.

[21] Appl. No.: 278,166

[22] Filed: Jun. 29, 1981

[51] Int. Cl.[3] ..... E21B 34/10

[52] U.S. Cl. ..... 166/323; 251/73

[58] Field of Search ..... 166/323, 317, 319, 373, 166/374, 332, 250, 264; 175/317, 318; 251/73 X, 66

[56] References Cited

U.S. PATENT DOCUMENTS

| | | | |
|---|---|---|---|
| Re. 29,638 | 5/1978 | Nutter | 73/151 |
| 3,089,546 | 5/1963 | Cochran | 166/332 |
| 3,850,250 | 11/1974 | Holden et al. | 166/315 |
| 3,930,540 | 1/1976 | Holden et al. | 166/215 |
| 3,970,147 | 1/1975 | Jessup et al. | 166/250 |
| 4,044,829 | 8/1977 | Jessup et al. | 166/264 |
| 4,058,165 | 11/1977 | Holden et al. | 166/314 |
| 4,311,197 | 1/1982 | Hushbeck | 166/332 X |
| 4,324,293 | 4/1982 | Hushbeck | 166/264 X |

*Primary Examiner*—Ernest R. Purser
*Assistant Examiner*—Michael Starinsky

[57] ABSTRACT

In accordance with an illustrative embodiment of the present invention, a pressure controlled reversing valve includes a housing defining a reversing port, a spring-loaded sleeve valve normally closing the reversing port, means for locking the sleeve valve in the closed position, an operator mandrel mounted for reciprocating movement within the housing, clutch means for shifting the locking means with the operator mandrel as it moves in one axial direction, means for urging the operator mandrel in the opposite axial direction, and means responsive to a series of excess annulus pressure changes for reciprocating the operator mandrel to causing shifting of the locking means by an amount sufficient to disable the same and permit the valve sleeve to open.

17 Claims, 8 Drawing Figures

Fig. 2D
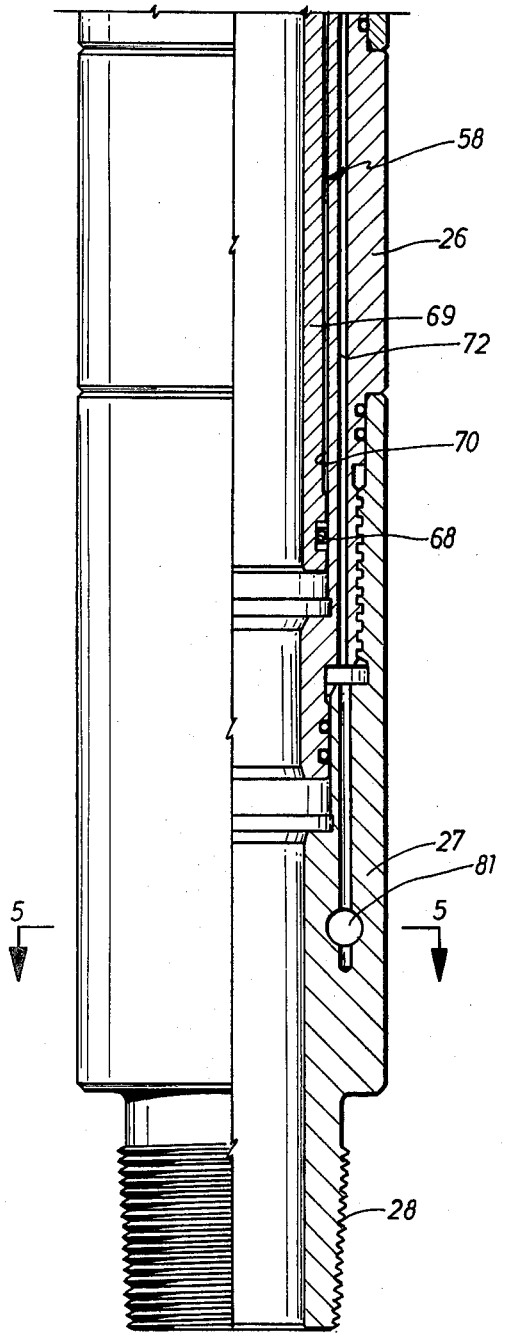
Fig. 3
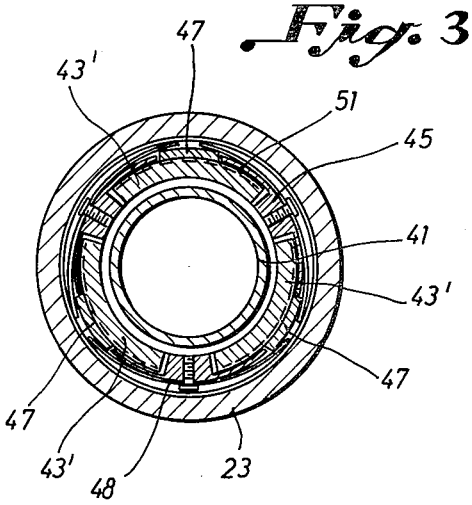
Fig. 4
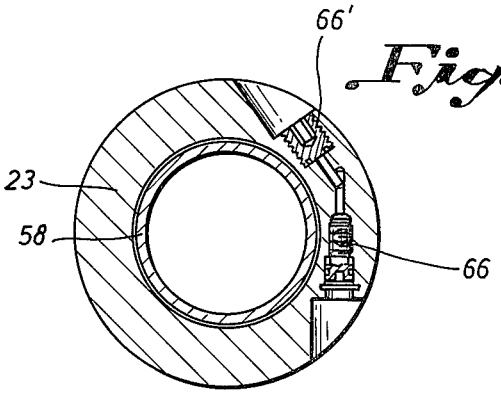
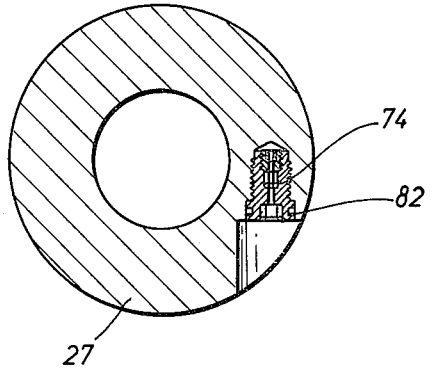
Fig. 5

ANNULUS PRESSURE CONTROLLED REVERSING VALVE

FIELD OF THE INVENTION

This invention relates generally to valve apparatus that is useful in drill stem testing operations, and particularly to a new and improved annulus pressure controlled reversing valve that can be operated in a reliable manner in response to a sequence of predetermined pressure changes.

BACKGROUND OF THE INVENTION

The fluids that are recovered from an earth formation during a drill stem test of the well accumulate in the pipe string that suspends the test tools. For safety reasons, it is necessary and desirable to remove the fluid recovery from the pipe string before withdrawing the tools from the well at the end of a test, so that oil will not be spilled at the rig floor as pipe joints are disconnected. Of course, any spilled oil can constitute a highly undesirable fire hazard.

Thus it is typical practice to include in a string of drill stem testing tools a device generally known as a reverse circulating valve. A reverse circulating valve is a tool that includes a normally closed valve element which can be opened to provide open communication between the well annulus and the pipe string at a point above the main test valve so that pressure applied to the well annulus can displace the fluid recovery upwardly to the surface where it can be piped safely to suitable containers.

When a drill stem test is being conducted in an offshore well from a floating vessel, it has become fairly standard practice to use annulus pressure changes to actuate the various valves and the like that are employed in the tool string. A reverse circulating valve that opens after a number of pressure change cycles is disclosed in U.S. Pat. Nos. 3,850,250, 3,930,540 and 4,058,165. This valve has a long closure sleeve that is pulled in incremental amounts toward the open position in response to reciprocation of a pressure responsive mandrel that is connected to the closure sleeve by a ratchet system. In addition to being somewhat complex and lengthy, this approach has the disadvantage of automatic opening after a certain number of annulus pressure changes have been made, whereas a particular well test may require more flexibility in the number of pressure changes that need to be applied in the course of a testing program. It is desirable to provide for more surface control over the precise point in time that the test will be terminated and the reversing valve opened so that the pipe can be purged of well fluids. Other pressure responsive reverse circulating valves are disclosed in U.S. Pat. Nos. 4,063,593 and 4,064,937. However, both of these valves are constructed in combination with a dual ball valve sampler apparatus, with the resultant structures being quite complex due to the multiple functions that are intended to be performed. Still another approach is described in U.S. Pat. Nos. 3,970,147 and 4,044,829 where the reversing valve is held closed by a selected number of shear pins intended to control the pressure setting. However, machining inaccuracies can cause the pins to be loaded differently so that a particular setting is not repeatable, and the atmospheric chamber used in this type of design can result in high seal friction which can disturb the expected pressure setting.

It is the general object of the present invention to provide a new and improved annulus pressure controlled reverse circulating valve that is simpler in construction and operation and thus more reliable in use than has heretofore been known in the art.

Another object of the present invention is to provide a new and improved annulus pressure controlled reverse circulating valve that can be opened at any time that it is desired to terminate the test and without regard to the number of pressure change cycles previously employed to operate associated test tools.

Still another object of the present invention is to provide a new and improved reverse circulating valve of type described that is repeatable in operation and will open reliably when certain pressure increases are applied to the well annulus.

SUMMARY OF THE INVENTION

These and other objects are attained in accordance with the concepts of the present invention through the provision of a valve apparatus comprising a tubular housing having a reversing port extending through the wall thereof, and a spring-biased sleeve valve movable in the housing from a closed position with respect to the reversing port to an open position with respect thereto. The valve sleeve is locked in the closed position by laterally shiftable latch dogs that are held in engagement with the valve sleeve by a locking sleeve that also is movably mounted in the housing. The locking sleeve can be moved to released position with respect to the latch dogs by means responsive to a sequence of well annulus pressure changes where the pressure increases are greater than that employed to actuate associated test valve equipment. Such means includes an actuator mandrel having a piston subject on one side to the pressure of a confined gas and on the other side to atmospheric or other low pressure and coupled to the locking sleeve by a one-way clutch mechanism. Responsive to a predetermined increase in well annulus pressure, means such as a rupture disc or the like is opened to enable annulus fluids under pressure to enter and act on said other piston side to force the actuator mandrel to shift until the applied annulus pressure and the nitrogen gas pressure are equal. As the applied pressure is released, the operator mandrel shifts in the opposite direction and functions via the one way clutch to pull the locking sleeve to an intermediate position. The next subsequent increase and release of annulus pressure causes a second reciprocation of the actuator mandrel which in turn causes the locking sleeve to release the latch dogs so that the spring can shift the valve sleeve to its open position.

BRIEF DESCRIPTION OF THE DRAWINGS

The present invention has other features, objects and advantages that will become more clearly apparent in connection with the following detailed description of a preferred embodiment, taken in conjunction with the appended drawings in which:

FIGS. 2A–2D, are longitudinal sectional views, with portions in side elevation, of a reversing valve apparatus in accordance with the present invention; and FIGS. 3, 4 and 5 are cross-sectional views taken on lines 3—3, 4—4, and 5—5 of FIGS. 2A, 2C and 2D respectively.

DESCRIPTION OF A PREFERRED EMBODIMENT

Figure 1:
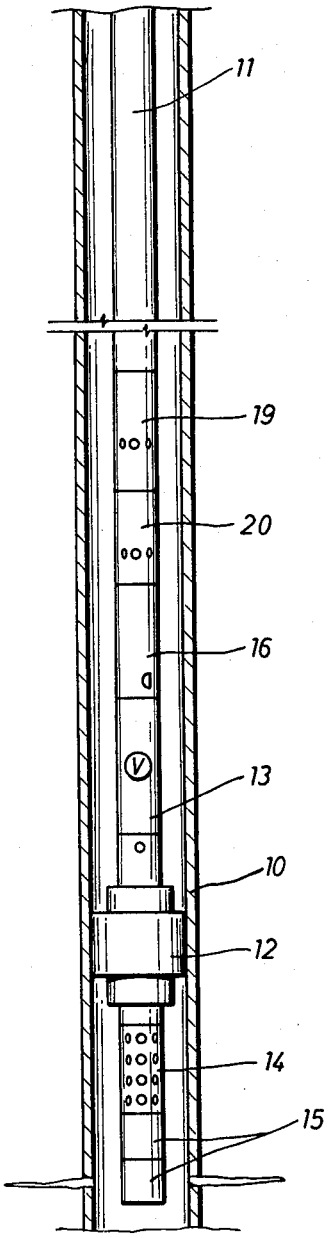
FIG. 1 is a somewhat schematic view of a string of pressure controlled drill stem testing tools in a well.

Referring initially to FIG. 1, there is shown schematically a string of drill stem testing tools suspended within a well casing 10 on drill pipe 11. The tool string includes a hook wall-type packer 12 that functions when set to isolate the well interval to be tested from the hydrostatic head of fluid thereabove, and a main test valve assembly 13 that functions to permit or to stop the flow of formation fluids from the isolated interval. The test valve 13 preferably is of a type that can be opened and closed in response to changes in the pressure of fluids in the annulus between the pipe 11 and the casing 10, and includes a closure element such as a ball valve that provides a full open bore when open. The ball valve is coupled to a pressure responsive valve actuator system of the type disclosed and claimed in Nutter U.S. Pat. No. Re. 29,638 which is incorporated herein by reference. A perforated tail pipe 14 may be connected to the lower end of the mandrel of the packer 12 to enable fluid in the well bore to enter the tools, and typical pressure recorders 15 are provided for the acquisition of pressure data during the test. Other equipment components such as a jar and a safety joint may be employed in the string of tools but are not illustrated in the drawings. A full-bore sampler apparatus 16 can be connected to the upper end of the test valve assembly 13 for the purpose of trapping the last flowing sample of formation fluids at the end of the test.

A pressure controlled reversing valve assembly 20 that is constructed in accordance with the principles of the present invention is connected in the pipe string 11 between the upper end of the sampler valve 16 and the lower end of a tubing pressure controlled reversing valve 19 that is disclosed and claimed in my application Ser. No. 253,786, Apr. 13, 1981 assigned to the assignee of this invention. As shown in detail in FIGS. 2A–2D, the reversing valve 20 includes a housing 21 having an upper sub 22, a port section 23, a body section 24, upper and lower cylinder sections 25 and 26, and a lower sub 27, all threaded end-to-end. The upper and lower subs 22 and 26 each have threads 28 to enable connecting the assembly in a tool string. The port section 23 has one or more reversing ports 30 that normally are blanked off by a valve sleeve 31 that has seals 32 and 33 engaging interior wall surfaces above and below the port 30. A compressed coil spring 34 that reacts between a downwardly facing shoulder 35 on the upper sub 22 and an upper end surface 36 of a guide ring 37 continuously urges the valve sleeve 31 downwardly toward its open position. The valve sleeve 31 is, however, releasably retained in the closed position by engagement of the lower end surface 38 of a depending portion 39 thereof with a plurality of dogs 40 that are laterally shiftable from an inner position, as shown, to an outer position clear of the said lower end surface. The dogs 40 are received in windows 42 cut through the wall of a clutch sleeve 43 that is rigidly fixed within the housing 21.

Figure 2A:
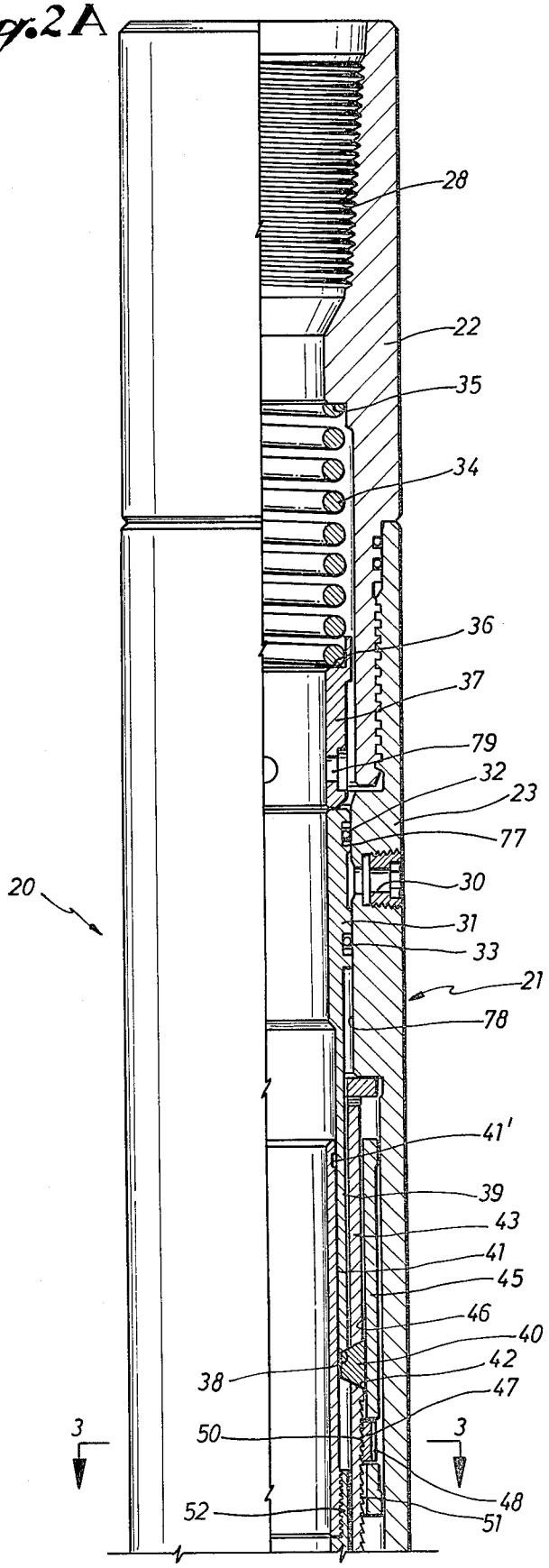
Figure 2B:
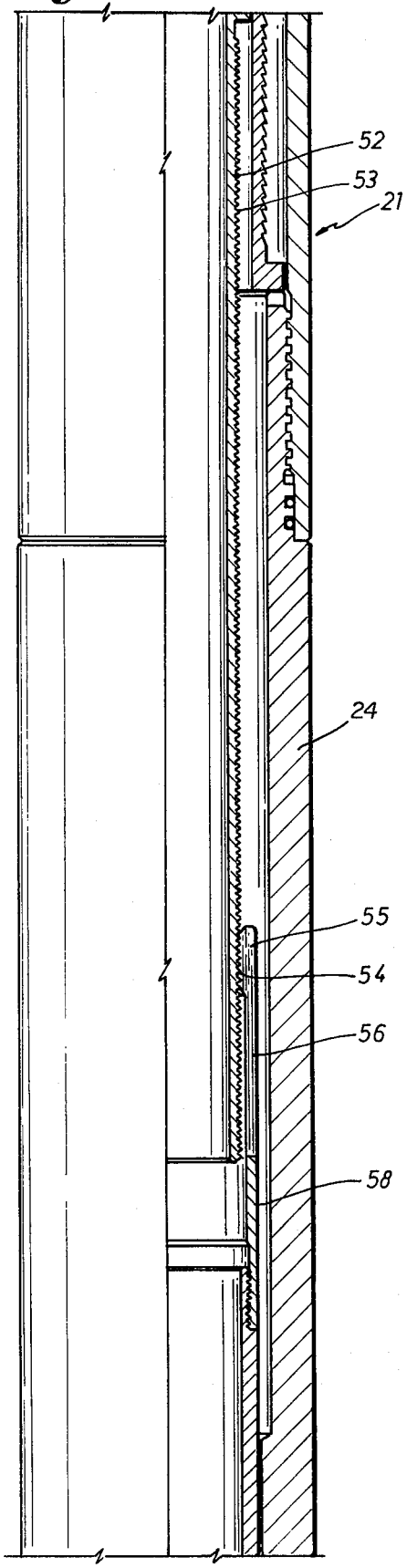

A locking and releasing sleeve 45 is mounted for vertical movement within the housing 21 from an upper position shown in FIG. 2A, where the inner wall surface 46 thereof locks the dogs 40 in their inner positions, to a lower position where the surface is clear of the dogs to enable their outward movement. A plurality of arcuate clutch nut segments 47 (FIG. 3) that are biased inwardly by a band spring 48 or the like have upwardly facing teeth 50 that engage downwardly facing the teeth 51 on the outer periphery of each of the upstanding, circumferentially spaced sections 43' of the clutch sleeve 43 to hold the locking sleeve 45 in the lowermost position to which it is moved during operation of the valve.

The locking sleeve 45 is attached to, and forms the upper end section of, an elongated operator mandrel 52 that is movable axially within the housing 21. If desired, a protection sleeve 41 can be connected to the upper end of the mandrel 52 and carry a wiper ring 41' that prevents sand or other debris from entering into the locking mechanism. Substantially all of the length of the mandrel 52 is provided with external threads 53 that are adapted to be engaged by internal threads 54 formed on the upper sections 55 of a plurality of laterally flexible spring fingers 56 that are formed on the upper end of an elongated actuator mandrel 58. The actuator mandrel 58 carries an upper seal 59 (FIG. 2C) that slidably engages an inner wall surface 60 on the housing section 24, and an intermediate seal 61 that is located on an outwardly directed flange 62 or piston that sealingly engages an inner wall surface 63 of the housing section. The seal 61 is arranged on a substantially larger diameter than the seal 59 to provide a variable capacity annular chamber 64 between the outer wall of the mandrel 58 and the inner wall of the housing section 25.

Figure 2C:
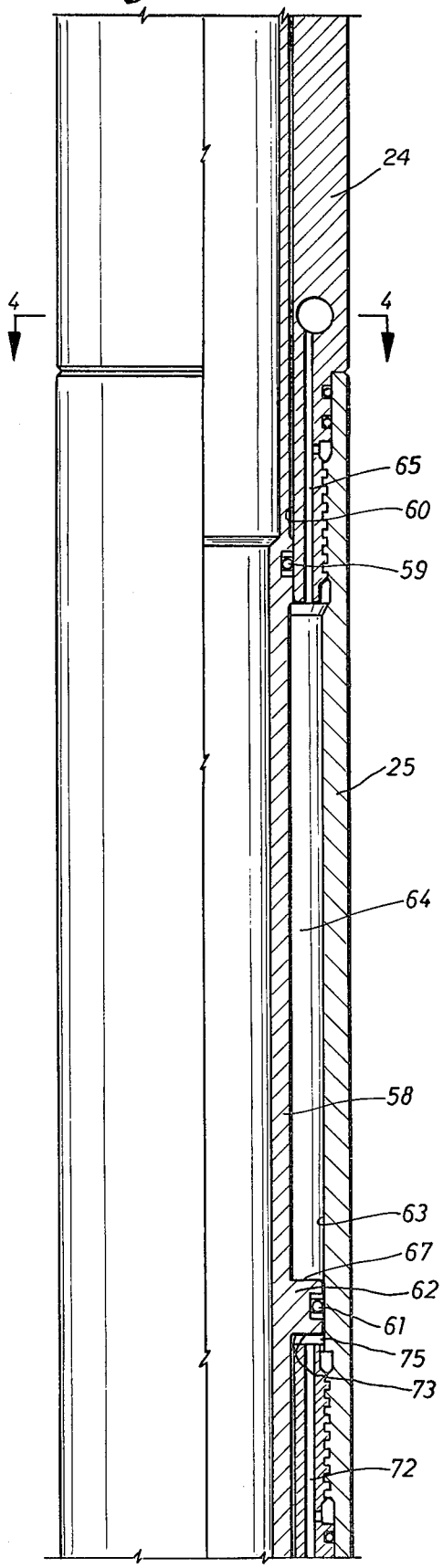

The chamber 64 is arranged to be filled with a suitable compressible medium such as nitrogen gas at a predetermined pressure via a passage 65 that leads from the chamber to a suitable closure valve 66 and plug 66' combination shown on FIG. 4. The pressure of the nitrogen gas acts downwardly on the upper face 67 of the piston 62 to continuously urge the actuator mandrel 58 toward its lower position as shown in FIG. 2C. A lower seal 68 (FIG. 2D) carried by the lower end section 69 of the actuator mandrel 58 slidably engages the inner wall surface 70 of the housing section 26 on substantially the same diameter as the seal diameter of the upper ring 59. A pressure path 72 that extends longitudinally through the wall of the housing section 26 communicates the lower face 73 of the piston 62 with a lateral port 81 that extends to the outside of the housing and which normally is closed by a plug assembly 82 that includes means such as a disc 74 having a central region that is adapted to rupture when subjected to a predetermined fluid pressure. Rupture of the disc 74 will admit well fluids at ambient pressure into the region 75 of the housing below the piston 62.

OPERATION

In operation, the string of test tools assembled in the combination shown in FIG. 1 is run into the well with the chamber 64 having been charged at the surface with nitrogen gas to a pressure that is substantially less than the hydrostatic pressure at test depth. For example, if the hydrostatic pressure is expected to be about 5000 psi, then the chamber 64 may be charged to a pressure of about 2500 psi. As the tool string is being lowered into the well bore, the test valve asembly 13 initially is closed, as are the reversing ports 30, so that the interior of the drill pipe 11 provides a low pressure region.

To conduct a formation test, the packer 12 is set by appropriate manipulation of the pipe string 11 to isolate the test interval, and the test valve 13 is opened to communicate the interval with the interior of the pipe string 11. Opening of the test valve 13 is effected by applying to the well annulus at the surface a predetermined amount of pressure as described in the aforementioned Nutter patent. The valve 13 is left open by maintaining such increase in annulus pressure for a flow period of time that is sufficient to draw down the pressure in the isolated interval, after which the applied pressure is relieved at the surface to enable the valve to close and shut-in the test interval. As the test valve 13 is operated, pressure data is recorded by the recorders 15 in a typical manner. The test valve 13 can be repeatedly opened and closed to obtain additional data as desired by repeatedly increasing and then relieving the pressure being applied to the well annulus.

When it is desired to open the reversing ports 30 to enable circulation of recovered formation fluids to the surface, a value of pressure is applied to the well annulus that exceeds that normally employed to actuate the test valve 13. For example, a pressure of 2500 psi may be applied which causes the central region of the disc 74 to rupture and admit fluid into the chamber 75 below the piston. A total of 7500 psi pressure will force the actuator mandrel 58 to move upwardly until the pressure of the nitrogen gas confined in the chamber 64 rises to 7500 psi. During upward movement the teeth 54 ratchet upwardly over the teeth 53, and when the applied pressure is relieved the mandrel 52 is forced downward, pulling the locking sleeve 45 downward therewith until the respective pressures in the chambers 64 and 75 again are equal at a value of about 5000 psi. The operator mandrel 52 does not return to its original position however, but rather to an intermediate position. As the upper portion of the locking sleeve 45 is shifted downward, the clutch nut segments 47 ratchet along the downwardly facing teeth 50 on the sleeve sections 43' and function to hold the locking sleeve 45 in the lowermost position to which it is moved. The reversing ports 30 are not yet opened during the initial change in annulus pressure as described above.

The excess pressure that is applied to initiate operation of the reversing valve 20 may also be used to actuate the sampler valve apparatus 16.

To complete the opening of the reversing valve 20, pressure again is applied to the well annulus to cause upward shifting of the actuator mandrel 58. The threads 54 on the spring fingers 56 again ratchet upwardly along the threads 53 to obtain a higher grip on the sleeve 52, and as the applied pressure is relieved the locking sleeve 45 is moved to a lower position where the upper end thereof is clear of the locking dogs 40. The dogs 40 thus are free to shift radially outward to their released positions so that the spring 34 can force the valve sleeve 31 downwardly to its open position. Preferably the upper seal ring 32 engages on a slightly lesser diameter wall surface 77 than the diameter on the wall surface 78 below the reversing port 30 as shown on FIG. 2A, so that annulus pressure can provide an additional bias force for shifting the valve sleeve 31 downwardly to its open positon. When the valve sleeve 31 has moved completely downward, a port 79 in the spring guide ring 37 is radially aligned with the reversing port 30 to provide completely open communication between the well annulus and the interior bore of the pipe string 11. Pressure then applied to the well annulus will cause fluids accumulated in the drill pipe 11 to be "reverse"circulated upwardly through the pipe and out of the same at the surface.

It now will be apparent that a new and improved pressure controlled reverse circulating valve has been disclosed which can be operated under complete control of the operator at the surface. The valve is relatively simple in construction and thus more reliable in operation. Since certain changes or modifications may be made by those skilled in the art without departing from the inventive concepts involved, it is the aim of the appended claims to cover all such changes and modifications falling within the true spirit and scope of the present invention.

What is claimed is:

1. Valve apparatus comprising: a tubular housing having port means extending through the wall thereof and being adapted to be connected in a pipe string that is disposed in a well bore; sleeve valve means movable in said housing from a closed position with respect to said port means to an open position with respect thereto; means biasing said sleeve valve means toward said open position; means for locking said sleeve valve means in said closed position; and means responsive to a series of changes in the pressure of fluids in the well annulus for disabling said locking means to enable said biasing means to shift said sleeve valve means to said open position; wherein said disabling means comprises an actuator mandrel mounted for reciprocating movement in said housing, hydraulically operable means for advancing said actuator mandrel in one direction responsive to an increase in well annulus pressure, means for returning said actuator mandrel in the opposite direction when said increase in pressure is reduced, and one-way clutch means for coupling said actuator mandrel to said locking means during each return movement of said actuator mandrel.

2. The apparatus of claim 1 wherein said locking means comprises laterally shiftable detent means movable from a position engaging said sleeve valve means to a position disengaged therefrom, and a locking sleeve that is movable axially of said housing from a position holding said detent means in said engaging position to a position enabling lateral shifting of said detent means to said disengaged position.

3. The apparatus of claim 2 wherein said returning means comprises a compressible fluid medium confined in a variable capacity chamber formed between said actuator mandrel and said housing, said hydraulically operable means including a piston on said actuator mandrel having one side subject to the pressure of said fluid medium and its other side initially subject to atmospheric or other low pressure.

4. The apparatus of claim 3 wherein said disabling means further includes means responsive to a predetermined increase in well annulus pressure for subjecting said other side of said piston to well annulus pressure, said actuator mandrel being advanced in said one direction until the pressure of said fluid medium and said well annulus pressure are substantially equal, the pressure of said fluid medium acting to return said actuator mandrel in said opposite direction as said well annulus pressure is reduced.

5. The apparatus of claim 2 wherein said one-way clutch means comprises ratchet means on said actuator mandrel cooperable with teeth on said locking sleeve, and means for preventing movement of said locking sleeve in said one direction during advancing movement of said actuator mandrel for causing said ratchet means to ratchet relatively along said teeth, said ratchet means coacting with said teeth to pull said locking sleeve in said opposite direction each time said increase in pressure is reduced.

6. The apparatus of claim 1 wherein said sleeve valve means is sealed with respect to said port means on different diameters to provide a bias force responsive to well annulus pressure that urges said sleeve valve means toward said open position.

7. The apparatus of claim 1, wherein said locking means comprises means movable from an inner position locking said sleeve valve means in said closed position to an outer position enabling said biasing means to shift said sleeve valve means to said open position; and wherein said disabling means comprises means for preventing movement of said detent means from said inner position to said outer position until the pressure fluid in the well annulus surrounding said housing has been repeatedly changed a predetermined number of times.

8. The apparatus of claim 7 further including a detent sleeve fixed within said housing, said detent means including at least one latch dog mounted on said detent sleeve for movement from said inner position to said outer position, said unlocking means including a locking sleeve surrounding said detent sleeve and mounted for axial movement with respect thereto, said locking sleeve having an inner surface engaging said latch dog.

9. The apparatus of claim 8 wherein said latch dog and said sleeve valve means have coengaged inclined surfaces tending to shift said latch dog to said outer position.

10. The apparatus of claim 8 further including additional clutch means for enabling axial movement of said locking sleeve relative to said detent sleeve in only one axial direction.

11. The apparatus of claim 10 wherein said additional clutch means includes at least one inwardly biased nut segment mounted on said detent sleeve and having inclined teeth on its inner periphery engagable with companion inclined teeth formed on the outer periphery of said detent sleeve, said last mentioned teeth facing in said one axial direction.

12. Valve apparatus comprising: a tubular housing have port means extending through the wall thereof and being adapted to be connected in a pipe string that is disposed in a well bore; sleeve valve means movable in said housing from an upper closed position with respect to said port means to a lower open position with respect thereto; spring means biasing said sleeve valve means toward said open position; laterally shiftable detent means movable from an inner position engaging said sleeve valve means to prevent opening movement thereof to an outer position disengaged from said sleeve valve means to permit said spring means to move said sleeve valve means to said open position; a locking sleeve movable in said housing from an upper position where an inner surface thereof prevents lateral shifting of said detent means to a lower position where said inner surface is clear of said detent means to enable said detent means to shift to said outer position; an actuator mandrel mounted for upward and downward movement in said housing and having piston means sealingly slidable with respect thereto, said mandrel and housing defining a variable capacity chamber containing a compressible fluid medium under pressure with the upper side of said piston means being continually subject to said pressure and the lower side of said piston means being initially subject to atmospheric or other low pressure whereby the pressure of said fluid medium exerts downward force on said actuator mandrel; means responsive to a predetermined value of well annulus pressure for exposing said lower side of said piston means to well annulus fluids whereby the pressure thereof exerts upward force on said actuator mandrel, said actuator mandrel moving upwardly in said housing when said upward force exceeds said downward force and downwardly in said housing when said downward force exceeds said upward force; one-way clutch means for enabling incremental downward movement of said locking sleeve with respect to said detent means and for preventing upward movement of said locking sleeve with respect thereto; and ratchet means on said actuator mandrel and said locking sleeve for pulling said locking sleeve downwardly during each downward movement of said actuator mandrel, so that a series of increases and reductions in the pressure of the fluids in the well annulus can be employed to disable said locking sleeve, enable lateral shifting of said detent means, and movement of said sleeve valve means from closed to open position.

13. The apparatus of claim 12 wherein said sleeve valve means and said detent means have coengaged inclined surfaces arranged to shift said detent means to said outer position when said inner surface of said locking sleeve clears said detent means.

14. The apparatus of claim 12 wherein said sleeve valve means is sealed with respect to said housing above and below said port means on different diameters, the diameter of sealing engagement below said port means being larger than the diameter of sealing engagement above said port means whereby the pressure of fluids in the well annulus can act via said port means to apply downward force on said sleeve valve means for assisting said spring means in moving said sleeve valve means to said open position.

15. The apparatus of claim 12 wherein said ratchet means comprises laterally flexible spring fingers on the upper end of said actuator mandrel, each of said spring fingers having teeth that cooperate with companion teeth on said locking sleeve, the teeth on said spring fingers ratcheting upwardly over the teeth on said locking sleeve during each upward movement of said actuator mandrel and gripping said teeth on said locking sleeve to pull said locking sleeve downward during each downward movement of said actuator mandrel.

16. The apparatus of claim 12 further including a detent sleeve fixed within said housing and having a window formed through the wall thereof, said detent means comprising a latch dog mounted in said window for movement from said inner position to said outer position, said latch dog having an upper surface engaging said sleeve valve means and a rear surface engageable with said inner surface of said locking sleeve.

17. The apparatus of claim 16 wherein said one-way clutch means includes at least one inwardly biased nut segment mounted on said detent sleeve and having upwardly facing teeth on its inner periphery engageable with companion downwardly facing teeth formed on the outer periphery of said detent sleeve.

* * * * *